US009829297B2

(12) United States Patent
Graswald

(10) Patent No.: US 9,829,297 B2
(45) Date of Patent: Nov. 28, 2017

(54) DEVICE FOR THE CONTROLLED INITIATION OF THE DEFLAGRATION OF AN EXPLOSIVE CHARGE

(71) Applicant: TDW Gesellschaft fuer verteidigungstechnische Wirksysteme mbH, Schrobenhausen (DE)

(72) Inventor: Markus Graswald, Pfaffenhofen an der Ilm (DE)

(73) Assignee: TDW Gesellschaft fuer verteidgungstechnische Wirksysteme mbH, Schrobenhausen (DE)

( * ) Notice: Subject to any disclaimer, the term of this patent is extended or adjusted under 35 U.S.C. 154(b) by 0 days.

(21) Appl. No.: 14/959,735

(22) Filed: Dec. 4, 2015

(65) Prior Publication Data

US 2016/0161236 A1 Jun. 9, 2016

(30) Foreign Application Priority Data

Dec. 6, 2014 (DE) ..... 10 2014 018 218

(51) Int. Cl.
*F42C 19/02* (2006.01)
*C06C 7/00* (2006.01)
(Continued)

(52) U.S. Cl.
CPC ..... *F42C 19/0838* (2013.01); *C06B 45/00* (2013.01); *C06C 7/00* (2013.01);
(Continued)

(58) Field of Classification Search
CPC ..... F42B 12/20; F42B 12/207; F42B 12/208; F42B 39/14; F42B 39/20; F42C 19/02;
(Continued)

(56) References Cited

U.S. PATENT DOCUMENTS 1,948,583 A 2/1934 Jeffries
2,217,645 A 10/1940 De Wilde et al.
(Continued)

FOREIGN PATENT DOCUMENTS

DE 100 08 914 C2 6/2003
DE 43 18 922 A1 4/2010
(Continued)

OTHER PUBLICATIONS

European Search Report issued in European counterpart application No. 15003412.2-1375 / 3029012 dated Jul. 22, 2016, with Statement of Relevancy (Ten (10) pages).
(Continued)

*Primary Examiner* — James S Bergin
(74) *Attorney, Agent, or Firm* — Crowell & Moring LLP

(57) ABSTRACT

A device for the controlled initiation of a subdetonative reaction of an explosive charge arranged in a shell includes at least one explosive charge core extending in a region of a longitudinal axis of the explosive charge. A transverse dimension of the explosive charge core is adaptable to a radial extent of the shell in a longitudinal direction of the explosive charge, while a charging of the explosive charge core is set homogeneously or locally variably over a length of the explosive charge core with respect to a type of explosive material.

18 Claims, 1 Drawing Sheet

(51) Int. Cl.
*C06B 45/00* (2006.01)
*F42B 12/20* (2006.01)
*F42C 19/08* (2006.01)

(52) U.S. Cl.
CPC ..... *F42B 12/20* (2013.01); *F42B 12/207* (2013.01); *F42B 12/208* (2013.01)

(58) Field of Classification Search
CPC .... F42C 19/095; F42C 19/0838; C06B 45/00; C06C 7/00
USPC ..... 102/473, 481, 499
See application file for complete search history.

(56) References Cited

U.S. PATENT DOCUMENTS

| | | | | |
|---|---|---|---|---|
| 2,463,709 | A | 3/1949 | McFarland | |
| 5,243,916 | A | 9/1993 | Freche et al. | |
| 6,352,029 | B1 | 3/2002 | Guirguis et al. | |
| 6,523,478 | B1 | 2/2003 | Gonzalez et al. | |
| 7,231,876 | B2 * | 6/2007 | Kellner | F42B 12/204 102/491 |
| 7,347,906 | B1 * | 3/2008 | Guirguis | C06B 45/00 102/389 |
| 7,845,282 | B2 * | 12/2010 | Sheridan | F42B 12/207 102/473 |
| 8,256,350 | B2 * | 9/2012 | Haskins | F42B 12/207 102/478 |
| 8,931,415 | B2 * | 1/2015 | Volkmann | F42B 3/16 102/217 |
| 9,109,865 | B2 * | 8/2015 | Haskins | F42B 12/207 |
| 2010/0037793 | A1 * | 2/2010 | Lee | C06B 23/003 102/275.8 |
| 2012/0227609 | A1 | 9/2012 | Volkmann | |

FOREIGN PATENT DOCUMENTS

| | | | | |
|---|---|---|---|---|
| DE | 10 2012 006 044 | B3 | 3/2013 | |
| EP | 1 912 037 | A1 | 4/2008 | |
| EP | 2 133 654 | A2 | 12/2009 | |
| EP | 2133654 | A2 * | 12/2009 | F42B 12/207 |
| EP | 2 824 414 | A1 | 1/2015 | |
| FR | 2 678 722 | A1 | 1/1993 | |
| FR | 2978238 | B1 * | 12/2014 | F42B 12/26 |
| GB | 643872 | A | 9/1950 | |
| GB | 2428083 | A * | 1/2007 | F42B 12/208 |
| GB | 2479966 | A | 11/2011 | |
| WO | WO 99/53263 | A2 | 10/1999 | |
| WO | WO 01/94277 | A2 | 12/2001 | |

OTHER PUBLICATIONS

German Office Action issued in German counterpart application No. 10 2014 018 218.5 dated Oct. 19, 2016 (Five (5) pages).

* cited by examiner

DEVICE FOR THE CONTROLLED INITIATION OF THE DEFLAGRATION OF AN EXPLOSIVE CHARGE

CROSS REFERENCE TO RELATED APPLICATION

This application claims priority under 35 U.S.C. §119 from German Patent Application No. 10 2014 018 218.5, filed Dec. 6, 2014, the entire disclosure of which is herein expressly incorporated by reference.

BACKGROUND AND SUMMARY OF THE INVENTION

The invention relates to a device for the controlled initiation of a subdetonative reaction—in particular the deflagration—of an explosive charge arranged in a shell, comprising at least one explosive charge core extending in a region of the longitudinal axis of the explosive charge.

A metered explosive charge for a warhead with two different ignition apparatuses is known from DE 100 08 914 C2. While the first ignition apparatus initiates the explosive charge detonatively, the further, oppositely oriented ignition apparatus is designed such that at most one subdetonative initiation may occur. The use of at least one detonation cord for this purpose is also known therefrom. In practice, a number of problems have arisen which, in extreme cases, can lead to a termination of the initiation or to complete detonative initiation.

In DE 10 2012 006 044 B3, a cylindrical explosive charge is described having a shell which has a measuring device arranged parallel to the detonation cord, which measuring device detects the progress of the current deflagration.

US 2012/0227609 A1 describes an ignition system with two different ignition apparatuses. The first ignition apparatus is conventionally designed for the detonative triggering of the explosive charge. The locally opposite second ignition apparatus is dimensioned for a deflagration initiation of the explosive charge. Because the same design principle with opposite ignition sites is used in this ignition system, from which the detonation waves run counter to one another, the already-known deficiencies also arise here.

In contrast, an object of the present invention is to develop an ignition device which is able to maintain a deflagrative initiation over the total length of the explosive charge, without migration in the axial or radial direction, dying out or transitioning into a detonation of the deflagration reaction during combustion.

This should occur in a robust manner such that, even in highly tamped active systems (such as penetrators), as well as under extreme military environmental conditions (in particular at very low and very high temperatures), the deflagration of the explosive charge occurs in a controlled and reliable manner.

This object is achieved according to the invention in that the explosive charge has an explosive charge core, the transverse dimension of which can be adapted to the radial extent of the shell in the longitudinal direction of the explosive charge, and that its charge is homogeneously or locally variably adjustable with respect to the type of explosive material over the length of the explosive charge core.

This results in various design options, which are described in the further claims and which enable an adaptation of this initiation to the local conditions in the explosive charge.

It is advantageous that the transverse dimension of the explosive charge core is adaptable to the extent of the shell in the longitudinal direction of the explosive charge. This may occur continuously or in stages, so that the explosive charge core can thus be adjusted to any form of shell.

By means of the charging of the explosive charge core over the length of the explosive charge core, which can be set homogeneously or locally variably with respect to the type of explosive material, varying types of explosive materials may also be combined with one another as needed into an explosive charge core.

Comparatively high-energy (highly explosive) and/or sensitive CHNO-based explosive materials, such as hexogen- or octogen-based explosive material mixtures, as well as RDX (cyclo-1,3,5-trimethylene-2,4,6-trinitramine, hexogen), HMX (cyclo-1,3,5,7-tetramethylene 2,4,6,8-tetranitramine, octogen), PETN (pentaerythritol tetranitrate), HNS (hexanitrostilbene), FOX-7 (1,1-diamino-2,2-dinitroethylene), FOX-12 (guanyl urea dinitramide), or mixtures thereof, have proven useful for explosive charge cores. Moreover, inert binders such as HTPB (hydroxyl-terminated polybutadiene), silicone rubber, polyurethane rubber, polystyrene, Estane, nylon, wax and/or graphite may be used In addition, the diameter of the explosive charge core may vary with a non-constant shell diameter and be directly adapted thereto. The charging of the explosive charge core is to be adapted here to the size and shape of the explosive charge.

In order to prevent a direct contact from the detonatively reacting explosive material core to the explosive charge and thereby dampen the shock wave upon detonation of the explosive charge core, it is helpful if the explosive charge core is surrounded by a sheath or tube. This sheath or tube may consist, for example, of a fabric, a composite material (GFK, CFK, CRC or CFRC), a plastic or a combination thereof. Among others, textile fibers, plastics (polymers) such as Kevlar, nylon, polyethylene, polypropylene, PTFE (Teflon), PVC, polystyrene, Plexiglass (acrylic glass) or polyurethane and also wax may come into consideration as materials for a sheathing.

The wall thickness and the material of the sheath or the tube may also be adapted continuously or in steps to the radial extent of the shell in the longitudinal direction of the explosive charge.

A subdetonative reaction is triggered with the deflagrator, which is initiated alone in the mode of least action. In the exemplary embodiment, this occurs by means of detonation of the explosive charge core, whereby the hot reaction gases convectively heat an energetic material which has not yet reacted. This continues further via the pores present in the explosive charge. There emerges a multiphase reaction zone in which, in contrast to detonation, the pressure and flame front are spatially separated from one another and may well propagate at different speeds. The reaction leads ultimately to an increase in pressure, under which the explosive material can also fail mechanically and form cracks and propagate further. The reaction speeds also depend on the tamping state of the explosive charge, i.e. the wall thickness and strength of the shell. The speeds of the flame and pressure fronts are typically below the speed of sound of the explosive charge.

A stable deflagration results from the rate of energy dissipation in comparison to the energy generation rate, which is controlled here by the explosive charge core. Below, some system-influencing factors are described and concrete numbers/number ranges are specified for individual parameters, at which deflagration can occur in a stable manner.

Insensitive, casted explosive charges contain a proportion of the plastic binder of at least 10%. The proportion of the explosive molecule for which RDX (cyclo-1,3,5-trimethylene-2,4,6-trinitramine, hexogen), HMX (cyclo-1,3,5,7-tetramethylene 2,4,6,8-Tetranitramine, octogen), NTO (5-nitro-1,2,4-triazole-3-one), FOX-7 (1,1-diamino-2,2-dinitroethylene), FOX-12 (guanyl urea dinitramide), inter alia, can offer is between 90 and 50%. Binders suitable for this purpose are, among others, a two-component resin with hydroxyl-terminated polybutadiene (HTPB), as well as silicone rubber, polyurethane rubber, polystyrene, Estane or nylon. In the binder matrix, the granular explosive material crystals are encapsulated. In principle, as a result of the manufacturing process, such a plastic bonded explosive charge has microscopically small pores. These pores determine the porosity of the explosive charge and provide the free surface necessary for the deflagration reaction. The porosities here are typically in the single-digit percent range, i.e. well below five percent. In order to increase the blast pressure effect, the explosive charge may also have a coated or uncoated metal powder with particles such as those of aluminum, magnesium, zirconium, titanium, tungsten, titanium carbide or zirconium carbide. Here, a typical goal of 15 to 25 mass percent is typically desirable, as long as the blast pressure is optimized. To increase the blast pressure, the explosive charge may also be enriched with up to 20 percent ammonium perchlorate (AP).

To avoid a shock initiated detonation of the explosive charge, it is expedient if the explosive charge has a comparatively low shock sensitivity. For this purpose, the Hugoniot properties of the materials of the explosive charge core and its surrounding sheath or tube are to be selected such that the shock impedance of the sheath/tube lead to a significant reduction in the grazing detonation pressure of the explosive charge core. The shock impedance Z can be determined with the known formula $$Z=\rho_0 \cdot U=\rho_0(c_0+s \cdot u)$$

with $\rho_0$ as density, U as shock velocity, $c_0$ as bulk acoustic velocity, s as slope and u as particle velocity. The shock pressure is then given by $$P=\rho_0 \cdot U \cdot u=Z \cdot u$$

Expediently, the resulting pressure at the interface of the cushioning material for the explosive charge should be below the shock initiation pressure. A critical diameter for a shock initiated detonation of the explosive charge of at least 5 mm, typically more than 10 mm, is also additionally convenient.

In order to promote an ignition of the explosive charge by means of hot spots due to the weak shock wave and the hot reaction gases, the explosive charge should have a comparatively low self-ignition temperature. This should be lower than 230° C., and typically clearly below 200° C. Nevertheless, it should be sufficiently large so as not to unnecessarily negatively affect the insensitivity of the explosive charge in thermal stimuli such as slow-cook-off and fast-cook-off tests.

In the presence of a charge shell, the relative parameters are wall thickness, as well as in comparison to the charge diameter, and the material strength.

These are expediently linked together through the static failure pressure. Above a specific limit pressure, unwanted transitions to stronger reactions (detonation-to-deflagration transitions, DDTs) are to be expected with higher probability. A tamping at the charge ends may be regulated through the venting described below such that hardly any difference to charges which are open at the ends can be shown. This is then reflected in similar expansion rates of charge shells and thus pressure rates due to the reaction of the explosive charge.

The failure pressure of a tamping under static load is calculated using $$p_{max} = \sigma_{max} \frac{1-k^2}{1+k^2}$$

with $$k = d_i / d_a,$$

$d_i$ as inner diameter, da as outer diameter and σmax as maximum voltage. A tamping with a static failure pressure less than 6.0 kbar, typically less than 2.6 kbar, is seen as expedient here, in so far as the initiation is optimally adjusted to the charging dimensions, in order to ensure a deflagration elapsing in a controlled manner. In contrast, higher tamping values, in particular if no adequate venting is present, favor transitions into stronger reactions (DDTs). In principle, the venting may be sustainably influenced by the charge cover, predetermined breaking points of the shell and bores, in so far as this is not a completely tamped explosive charge. The venting is particularly advantageous in the area of the initiation, where the deflagration reaction begins and the pressure thereby rises first.

Particularly suitable as shell materials are, for example, not only metals such as steel, aluminum, titanium or corresponding alloys, but also plastics or composite materials such as GRP or CRP, as well as CRC or CFRC. A lower lethal effect, but on the other hand a higher pressure wave, is thereby achieved. In the use of non-metallic shell materials, the effect on blast overpressure and heat is ultimately limited, wherein both decrease rapidly with distance from the place of reaction.

An exemplary embodiment is shown in the drawings and described in more detail below.

DETAILED DESCRIPTION OF THE DRAWINGS

Figure 1:
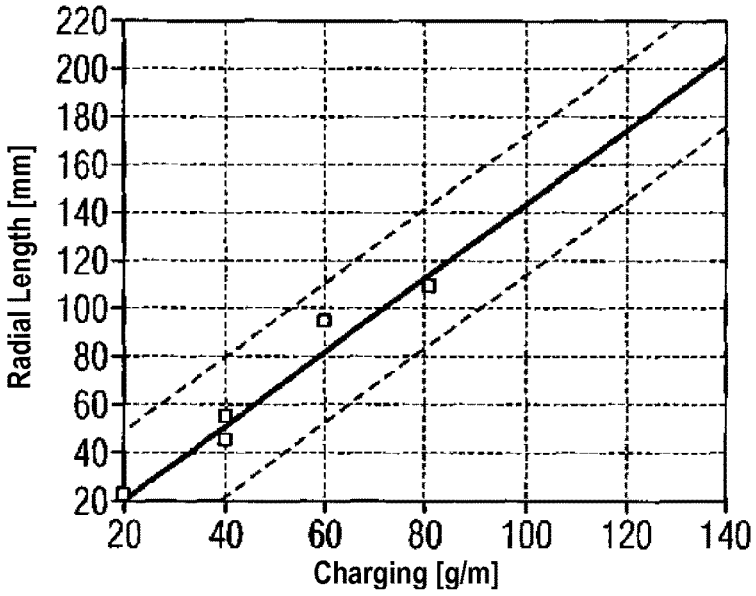
FIG. 1: shows the radial length of an explosive charge in relation to the charging of an explosive charge core.

In FIG. 1, the inner radius (radial length) from the central axis to the inner wall of the shell is indicated vertically, and the suitable charging of an explosive core is indicated horizontally. A stably elapsing deflagration is achieved within the dotted lines. Above the dotted lines, the deflagration transitions into a combustion reaction and/or dies out completely and below, it transitions unchecked into a stronger reaction, such as a partial or complete detonation.

Figure 2:
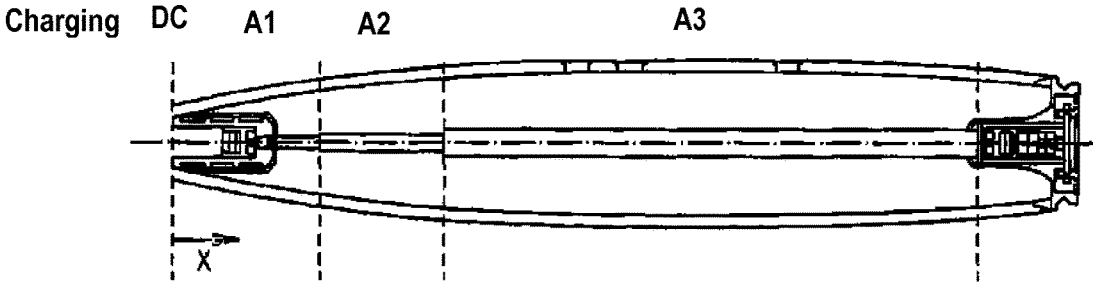
FIG. 2: shows an exemplary embodiment of a device according to one embodiment of the invention in use in a known operative system.

In FIG. 2, a section through an operative system is shown, which is filled with explosive material SP within the shell HÜ up to a narrow cavity in the region of the longitudinal axis LA. This cavity, not further designated, serves to accommodate the explosive charge core SK. The explosive charge core extends from a first ignition apparatus Z1 at the top of the operative system to a further, second ignition apparatus Z2 at the rear of the operative system. Both ignition apparatuses may be used to initiate the explosive charge core.

According to one embodiment of the invention, the explosive charge core SK is divided into a plurality of sections A1, A2, A3. Here, a division in fewer or more sections may also be sensible depending on the requirements of the operative system. These sections respectively correspond to a charging of the explosive charge core SK which is precisely adapted for this section. It is also possible to adapt the extent of the charging corresponding to the extent of the shell HÜ such that, after a higher value in the central region, the charging decreases again towards the end.

Typical charging values which show promise in the different regions have already been identified. Thus, a charging in section A1 may lie in the range of values from 30 to 70 g/m, in the second region A2 in the range of values from 50 to 90 g/m and finally in the third region A3 in the range of values from 70 to 100 g/m.

Figure 3:
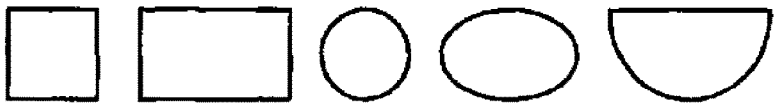
FIG. 3: shows examples of possible cross-sections of explosive charge cores.

A further possibility for adaptation is the choice of the cross section of the explosive charge core SK. Depending on the need for adaptation, this may be angular, round-oval, semi-circular in form, as is shown in FIG. 3.

Due to the possibilities for adaptation, explosive charge cores of almost any shapes and sizes of warheads and other operative systems may find application.

A further advantage is the significant reduction of the initial velocity of fragments from the shell. Also of advantage is the considerable reduction of the maximum blast pressure. This can be characterized simply on the basis of assessment of the performance of an explosive charge $$\rho \cdot D^2/4$$

with ρ as density and D as reaction speed, primarily the detonation speed, of the explosive charge. As a result of the significantly reduced reaction speeds and reaction pressures, the performance during deflagration can thus be reduced to 5 to 15 percent compared to the detonative reaction of the explosive charger.

What is claimed is:

1. A device for the controlled initiation of a subdetonative reaction of an explosive charge arranged in a shell, the device comprising:

at least one explosive charge core extending along a longitudinal axis of the explosive charge, the explosive charge core including:

a transverse dimension that varies according to a radius of the shell along the longitudinal axis, and a length over which a charging of explosive material of the explosive core is locally varied with respect to a type of the explosive material.

2. The device according to claim 1, wherein the charging of the explosive charge core varies according to the shell radius along the longitudinal axis.

3. The device according to claim 1, wherein the explosive material is arranged in the explosive charge core based on density and/or percentage composition of the explosive material.

4. The device according to claim 3, wherein a mixture of explosive molecules and inert binders comprise the explosive charge core, and wherein the inert binders comprise at least one of HTBP, silicone rubber, polyurethane rubber, polystyrene, Estane, nylon, wax and graphite.

5. The device according to claim 3, wherein a detonation speed of the explosive charge core is equal to or slightly less than a detonation speed of the explosive charge.

6. The device according to claim 3, wherein a self-ignition temperature of the explosive charge core is below 230° C.

7. The device according to claim 1, wherein a ratio of the transverse dimension of the explosive charge core to a diameter of the explosive charge is between 1/10 and 1/30.

8. The device according to claim 1, wherein the explosive charge core is surrounded by a sheath.

9. The device according to claim 8, wherein a wall thickness and/or a material of the sheath varies according to the radius of the shell along the longitudinal direction of the explosive charge.

10. The device according to claim 8, wherein a wall thickness of the sheath lies in a range of sizes of the transverse dimension of the explosive charge core, which is less than said wall thickness.

11. The device according to claim 1, wherein the explosive charge core is surrounded by a tube.

12. The device according to claim 11, wherein a wall thickness and/or a material of the tube varies according to the radius of the shell along the longitudinal direction of the explosive charge.

13. The device according to claim 11, wherein a wall thickness of the tube lies in a range of sizes of the transverse dimension of the explosive charge core, which is less than said wall thickness.

14. The device according to claim 1, wherein the explosive charge comprises a casted explosive charge with a CHNO-based explosive molecule comprised of at least one of RDX, HMX, NTO, FOX-7 and FOX-12, encapsulated in an inert binder comprised of at least one of HTPB, silicone rubber, polyurethane rubber, polystyrene, Estane and nylon.

15. The device according to claim 14, wherein the casted explosive charge further comprises additional metal powder comprising one or more of aluminum, magnesium, zirconium, titanium, tungsten, titanium carbide, zirconium carbide and ammonium perchlorate (AP).

16. The device according to claim 1, wherein the explosive charge is surrounded by a shell made from at least one of metals, plastics or composite materials.

17. The device according to claim 16, wherein the metal is at least one of steel, aluminum, titanium and corresponding alloys thereof, and wherein the composite materials are at least one of GRP, CFRP, CRC and CFRC.

18. The device according to claim 16, wherein a ratio of a mass of the shell to a mass of the explosive charge is between 1.0 and 8.0, and wherein a static failure pressure of the shell is under 6 kbar.

* * * * *